US007089600B2

(12) United States Patent
Morita

(10) Patent No.: US 7,089,600 B2
(45) Date of Patent: Aug. 15, 2006

(54) WORK GLOVE

(75) Inventor: Kazuaki Morita, Himeji (JP)

(73) Assignee: Showa Co., (JP)

( * ) Notice: Subject to any disclaimer, the term of this patent is extended or adjusted under 35 U.S.C. 154(b) by 184 days.

(21) Appl. No.: 10/804,749

(22) Filed: Mar. 19, 2004

(65) Prior Publication Data

US 2004/0187189 A1 Sep. 30, 2004

(30) Foreign Application Priority Data

Mar. 25, 2003 (JP) ..... 2003-081658

(51) Int. Cl.
*A41D 19/00* (2006.01)

(52) U.S. Cl. ..... 2/161.6

(58) Field of Classification Search ..... 2/16, 2/20, 161.1, 161.6, 167
See application file for complete search history.

(56) References Cited

U.S. PATENT DOCUMENTS 2,060,961 A * 11/1936 Tillotson ..... 427/288
3,268,355 A * 8/1966 Brodeur, Jr. ..... 427/374.2
4,371,988 A * 2/1983 Berend ..... 2/167
5,113,532 A * 5/1992 Sutton ..... 2/167
5,231,700 A * 8/1993 Cutshall ..... 2/161.7

FOREIGN PATENT DOCUMENTS

| | | |
|---|---|---|
| JP | 05-093302 | 4/1993 |
| JP | 09-105009 | 4/1997 |
| JP | 27-10848 | 2/1998 |

* cited by examiner

*Primary Examiner*—Katherine M. Moran
(74) *Attorney, Agent, or Firm*—Kusner & Jaffe

(57) ABSTRACT

A long lifetime work glove is provided for use in works of pulling a rope and the like during fishing, for example. A first reinforcement coat is formed on the surface of a fiber-made base glove to cover a portion that extends along sides of and towards tips of a thumb and a forefinger through the center of a crotch between the thumb and forefinger, by adhering to the portion a liquid of compound rubber latex, and a second reinforcement coat is formed to cover the surface of the base glove except the back thereof, by adhering a liquid of compound rubber latex to the corresponding surface area of the base glove including the portion already covered with the first reinforcement coat.

4 Claims, 4 Drawing Sheets

WORK GLOVE

FIELD OF THE INVENTION

The present invention relates to a work glove suitable for use in various works in fishing, farming and other industries.

BACKGROUND OF THE INVENTION

There has been a known reinforced work glove which is manufactured by forming a single layer reinforcement coat on the surface of a fiber-made base glove (hereinafter simply called "base glove"), by adhering to the base glove a liquid of compound rubber latex containing synthetic rubber as its main component.

The above mentioned work glove manufactured by adhering the liquid of compound rubber latex to the base glove is intended for use mainly in outdoor heavy works. However, while pulling a rope or the like in the fishing industry, for example, the gloves are prone to be worn out and broken at the crotch portion between the thumb and the forefinger of the glove, in spite of the reinforcement coat formed over the surface of the base glove. Thus, there has been a problem that the work gloves have a short lifetime.

SUMMARY OF THE INVENTION

An advantage of the present invention is to provide a long lifetime work glove for use in works of pulling a rope and the like during fishing, for example.

A work glove according to the present invention is characterized as follows:

A first reinforcement coat is formed on the surface of a fiber-made base glove to cover a portion that extends along sides of and towards tips of a thumb and a forefinger through a center of a crotch between the thumb and the forefinger, by adhering to the portion a liquid of compound rubber latex, and a second reinforcement coat is formed to cover the surface of the base glove except a back thereof, by adhering a liquid of compound rubber latex to the corresponding surface area of the base glove including the portion already covered with the first reinforcement coat.

The first reinforcement coat is formed to cover the portion that extends lengthwise along the sides of and towards the tips of the thumb and forefinger through the center of the crotch between the thumb and forefinger, ranging in the lengthwise direction from 5 mm from the center of the crotch up to the tips of the thumb and forefinger, and in the widthwise direction from 5 mm to 10 cm.

And, the first reinforcement coat is formed to cover the entire thumb and forefinger of the base glove.

DESCRIPTION OF THE EMBODIMENT

Figure 1:
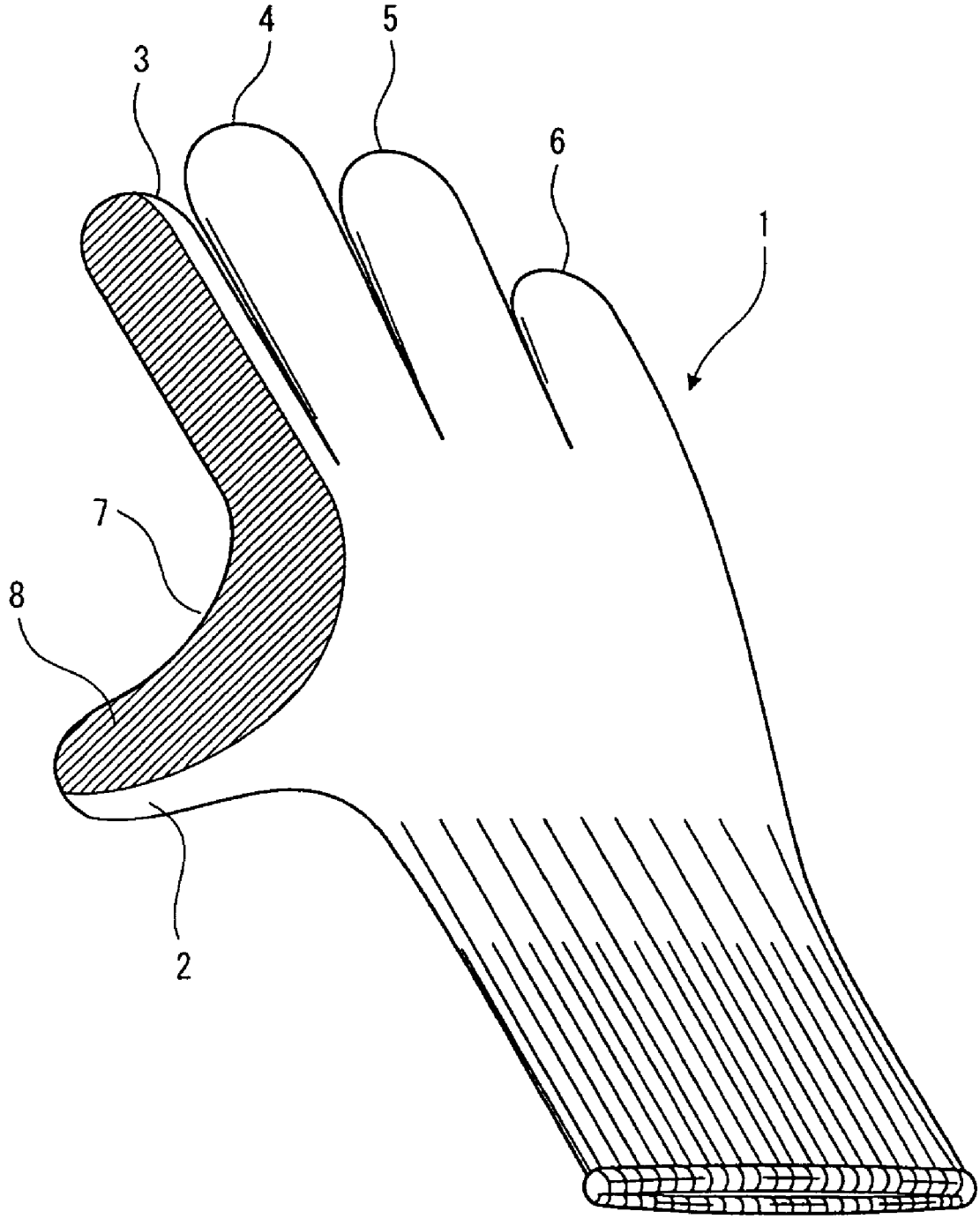
FIG. 1 is a perspective of a work glove before completion, showing that a first reinforcing coat is formed on a base glove at a crotch between a thumb covering portion and a forefinger covering portion according to a first embodiment of the present invention.
Figure 2:
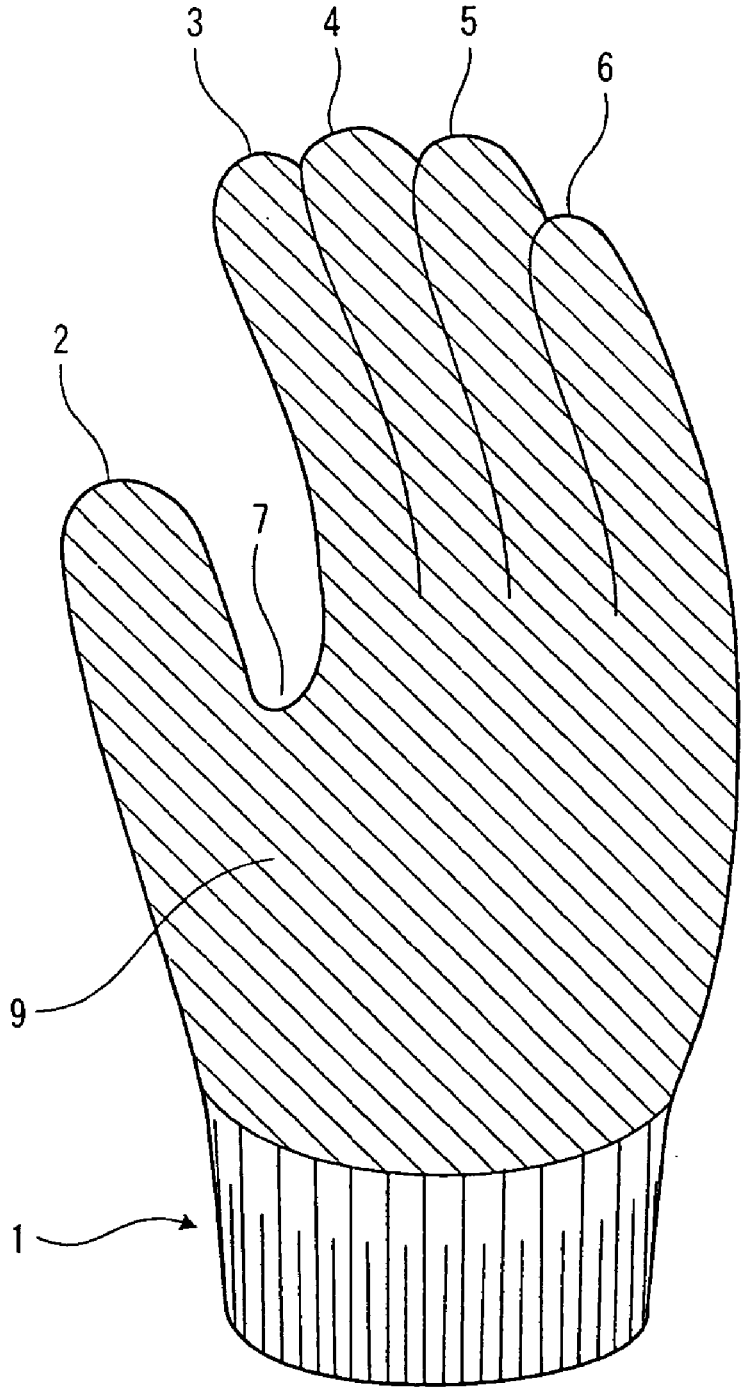
FIG. 2 is a perspective view of a completed work glove as seen from the palm side of the glove.
Figure 3:
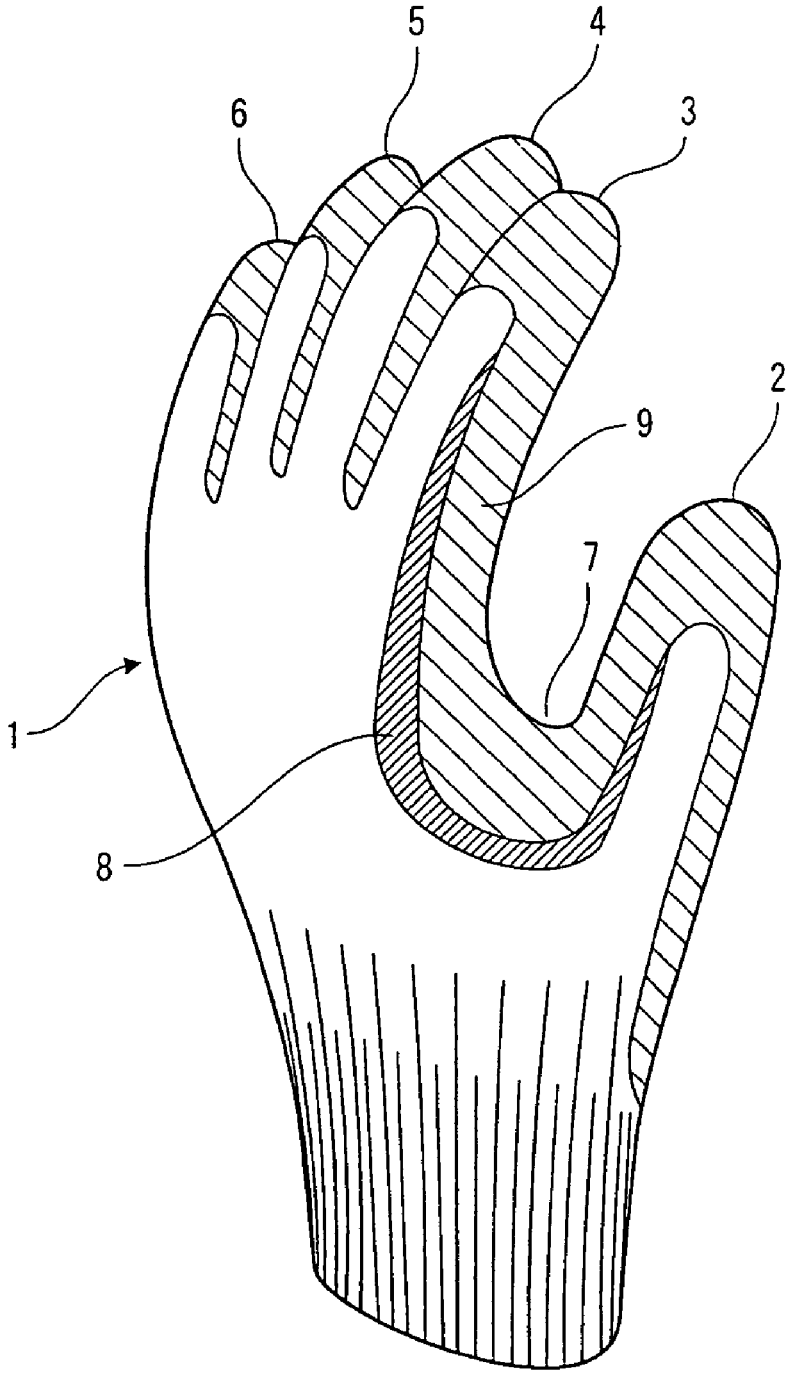
FIG. 3 is a perspective view of the completed work glove as seen from the back side of the glove.
Figure 4:
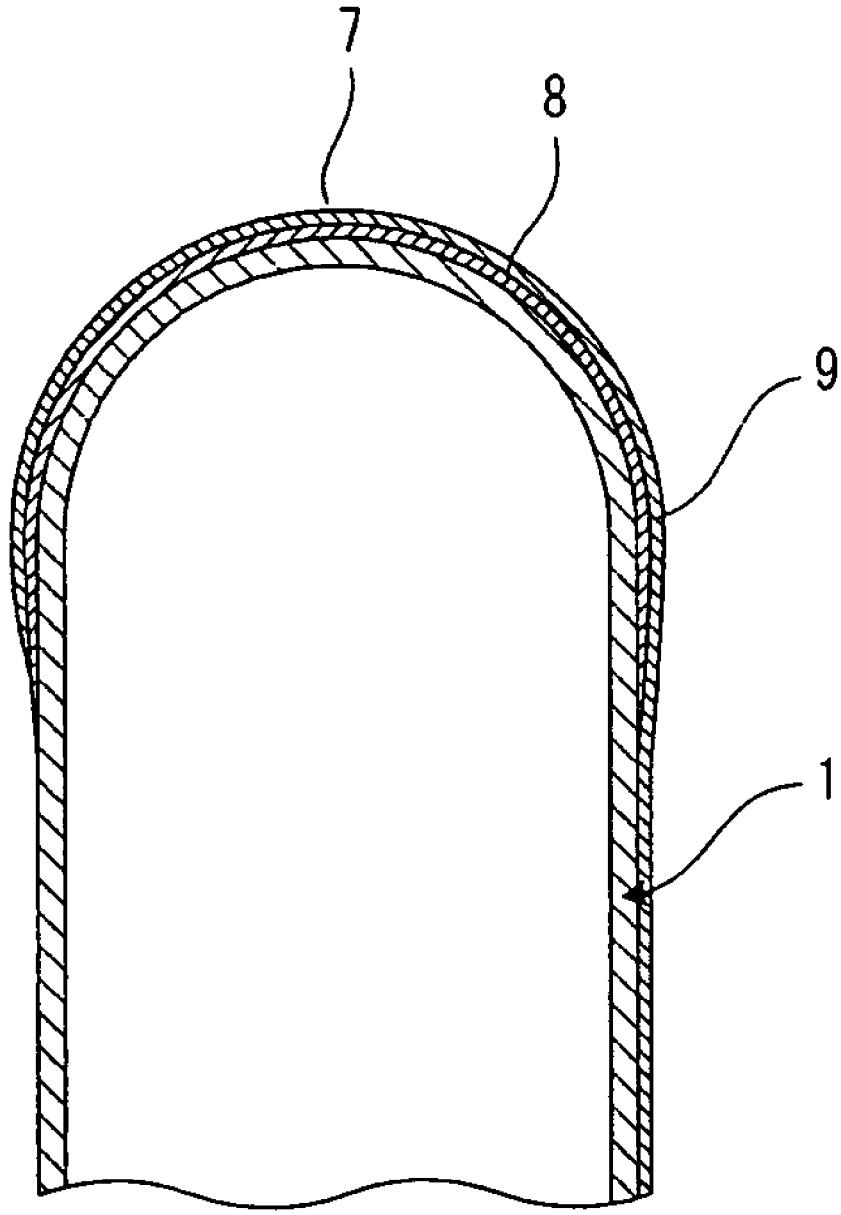
FIG. 4 is an enlarged section view of an essential part of the completed work glove.

FIGS. 1 to 4 show one embodiment of the present invention.

In these figures, reference numeral 1 indicates a fiber-made base glove having five fingers 2 to 6, from a thumb 2 to a little finger 6. A first reinforcement coat 8 is formed on the surface of the base glove 1 to cover a portion that extends along the sides of and towards the tips of the thumb and forefinger, through the center of a crotch 7 between the thumb 2 and forefinger 3, by adhering to the portion a liquid of compound rubber latex containing natural rubber or synthetic rubber as its main component. And, a second reinforcement coat 9 is formed to cover the surface of the base glove 1 except the back of the glove and including the portion already covered with the first reinforcement coat 1, by adhering to the corresponding surface area of the base glove the same compound rubber latex liquid as used to form the first reinforcement coat 8 or another type of compound rubber latex liquid. In other words, the reinforcement coats 8, 9 are formed in a double-layer structure over the portion that extends along the sides of and towards the tips of the thumb 2 and forefinger 3, through the center of the crotch 7.

In the embodiment, as shown in the Figures, the first reinforcement coat 8 is formed on the base glove 1 to cover the portion that ranges in the lengthwise direction along the sides of and towards the tips of the thumb 2 and finger 3 through the center of the crotch 7, and in the widthwise direction (transversely to the lengthwise direction) for about 3 cm. This portion covered by the first reinforcement coat 8, however, may range in the lengthwise direction from minimum 5 mm from the center of the crotch up to the tips of the thumb 2 and forefinger 3, and in the widthwise direction between 5 mm and 10 cm. If the portion covered by the first reinforcement coat 8 is smaller than the area defined by the above mentioned lower limits (5 mm in lengthwise direction and 5 mm in widthwise direction), an intended reinforcement effect cannot be provided, and if the portion is larger than the area defined by the upper limits, the glove itself becomes hardened and gives poor comfortableness to a user or wearer.

In another embodiment, the reinforcement coat 8 may be formed to cover the entire thumb 2 and forefinger 3 of the base glove 1.

What is claimed is:

1. A work glove comprising; a fiber-made base glove, a first reinforcement coat of compound rubber latex on a surface of the base glove said first reinforcement coat covering only a portion of the surface that extends along sides of and towards tips of a thumb and a forefinger through a center of a crotch between the thumb and forefinger, and a second reinforcement coat of compound rubber latex, said second reinforcement coat covering the surface of the base glove except a back thereof, including the portion covered with the first reinforcement coat.

2. The work glove according to claim 1, wherein the first reinforcement coat covers the portion that extends lengthwise along the sides of and towards the tips of the thumb and forefinger through the center of the crotch between the thumb and forefinger, ranging from the center of the crotch up to the tips of the thumb and forefinger, and approximately 3 cm in a widthwise direction.

3. The work glove according to claim 1, wherein the first reinforcement coat covers the entire thumb and forefinger of the base glove.

4. A method of manufacturing a work glove, comprising the steps of:

forming a first reinforcement coat on a surface of a base glove to cover only a portion that extends along sides of and towards tips of a thumb and a forefinger through a center of a crotch between the thumb and forefinger, by adhering to the portion a liquid of compound rubber latex, and forming a second reinforcement coat on the surface of the base glove except a back thereof, by adhering a liquid of compound rubber latex to the corresponding surface area of the base glove including the portion covered with the first reinforcement coat.

* * * * *